US005605131A

United States Patent [19]

Ohno et al.

[11] Patent Number: 5,605,131

[45] Date of Patent: Feb. 25, 1997

[54] ENGINE OUTPUT CONTROL SYSTEM FOR VEHICLE

[75] Inventors: Tetsuya Ohno; Toru Kitamura; Kenichirou Ishii; Toshiaki Hirota, all of Saitama, Japan

[73] Assignee: Honda Giken Kogyo Kabushiki Kaisha, Tokyo, Japan

[21] Appl. No.: 603,341

[22] Filed: Feb. 20, 1996

[30] Foreign Application Priority Data

Feb. 21, 1995 [JP] Japan ..... 7-032188

[51] Int. Cl.[6] ..... F02D 7/00

[52] U.S. Cl. ..... 123/399

[58] Field of Search ..... 123/399, 419, 123/481, 361

[56] References Cited

U.S. PATENT DOCUMENTS 5,437,253 8/1995 Huffmaster et al. ..... 123/399

5,456,231 10/1995 Suzuki et al. ..... 123/399

FOREIGN PATENT DOCUMENTS 2-201061 8/1990 Japan .

*Primary Examiner*—Raymond A. Nelli

*Attorney, Agent, or Firm*—Armstrong, Westerman, Hattori, McLeland & Naughton

[57] ABSTRACT

A target drive shaft torque is calculated from an accelerator pedal opening degree and a vehicle speed. During acceleration of the vehicle wherein target device shaft torque is not negative, a target engine torque for generating target drive shaft torque is calculated, and a target throttle opening degree for providing target engine torque is determined. On the other hand, during deceleration of the vehicle wherein target drive shaft torque is negative, a target throttle opening degree is determined from accelerator pedal opening degree at which the drive shaft torque is zero and the throttle opening degree at which the engine torque is zero. This target throttle opening degree is in a proportional relation to the accelerator pedal opening degree and thus when accelerator pedal opening degree target throttle opening degree.

3 Claims, 7 Drawing Sheets

ENGINE OUTPUT CONTROL SYSTEM FOR VEHICLE

FIELD OF THE INVENTION

The present invention relates to an engine output control system for a vehicle for controlling an engine output by electrically regulating a throttle opening degree in accordance with an accelerator pedal opening degree.

BACKGROUND OF THE INVENTION

An engine output control system for a vehicle for controlling engine output is already known, for example, as described in Japanese Patent Application Laid-open No. 201061/90. Such engine output control system for a vehicle electrically controls the opening and closing of a throttle valve by a drive-by-wire, for converting the target drive shaft torque of the vehicle, determined based on the accelerator pedal opening degree, into a target engine torque by use of a gear ratio of an automatic transmission and a torque ratio of a torque converter, and to open or close the throttle valve, such as, to approach a target throttle opening degree at which the target engine torque can be obtained.

In such prior art engine output control system, the throttle opening degree is indirectly determined from the target drive shaft torque and, hence, when the driver releases his or her foot from the accelerator pedal to fully close the accelerator pedal, the throttle valve does not necessarily reach a fully closed state. Thus, the fully closed position of the accelerator pedal does not coincide with the fully closed position of the throttle valve, in some cases. For this reason, when the fuel-cutting is to be conducted, for example, in the fully closed state of the throttle valve, fuel-cutting cannot reliably be achieved even, if the driver releases his or her foot from the accelerator pedal, resulting in a disadvantage that the specific fuel consumption and driveability are deteriorated.

The present invention overcomes the disadvantage that the actual accelerator opening degree does not coincide with the throttle opening degree in a lower accelerator opening degree range.

To achieve the above, there is provided an engine output control system for a vehicle for controlling engine output by electrically regulating a throttle opening degree in accordance with an accelerator opening degree, comprising: a target driving torque calculating means for calculating a target driving torque based on accelerator opening degree and vehicle speed; a target engine torque calculating means, for calculating a target engine torque, based on the target driving torque and shift position; a first output control quantity calculating means for calculating a first output control quantity of an engine, based on the target engine torque and a number of revolutions of the engine; an accelerator opening degree calculating means, for calculating the accelerator opening degree at which the target driving torque is equal to or smaller than a first predetermined value, based on the vehicle speed; a throttle opening degree calculating means, for calculating the throttle opening degree at which the engine torque is equal to or smaller than a second predetermined value, based on the number of revolutions of the engine; a second output control quantity calculating means, for calculating a second output control quantity of the engine, based on the accelerator opening degree calculated in the accelerator opening degree calculating means and the throttle opening degree calculated in the throttle opening degree calculating means; a selecting means, for selecting the first or second output control quantity, based on the target driving torque; and an engine output control means, for controlling the engine output, based on the selected first or second output control quantity.

The first predetermined value is zero, and the second predetermined value is zero.

The selecting means selects the second output control quantity, when the target driving torque is equal to or smaller than the first predetermined value.

The target driving torque calculating means calculates a target driving torque, based on the accelerator opening degree and the vehicle speed. The target engine torque calculating means calculates a target engine torque, based on the target driving torque and the shift position. The first output control quantity calculating means calculates a first output control quantity of the engine, based on the target engine torque and the number of revolutions of the engine. On the other hand, the accelerator opening degree calculating means calculates an accelerator opening degree at which the target driving torque is equal to or smaller than the first predetermined value, based on the vehicle speed. The throttle opening degree calculating means calculates a throttle opening degree at which the engine torque is equal to or smaller than the second predetermined value, based on the number of revolutions of the engine. The second output control quantity calculating means calculates a second output control quantity of the engine, based on the accelerator opening degree calculated in the accelerator opening degree calculating means and the throttle opening degree calculated in the throttle opening degree calculating means. The selecting means selects the first or second output control quantity, based on the target driving torque, and the engine output control means controls the engine output, based on the selected first or second Output control quantity.

DESCRIPTION OF THE DRAWINGS

The present invention will now be described with reference to the accompanying drawings in which.

DESCRIPTION OF THE PREFERRED EMBODIMENTS

Figure 1:
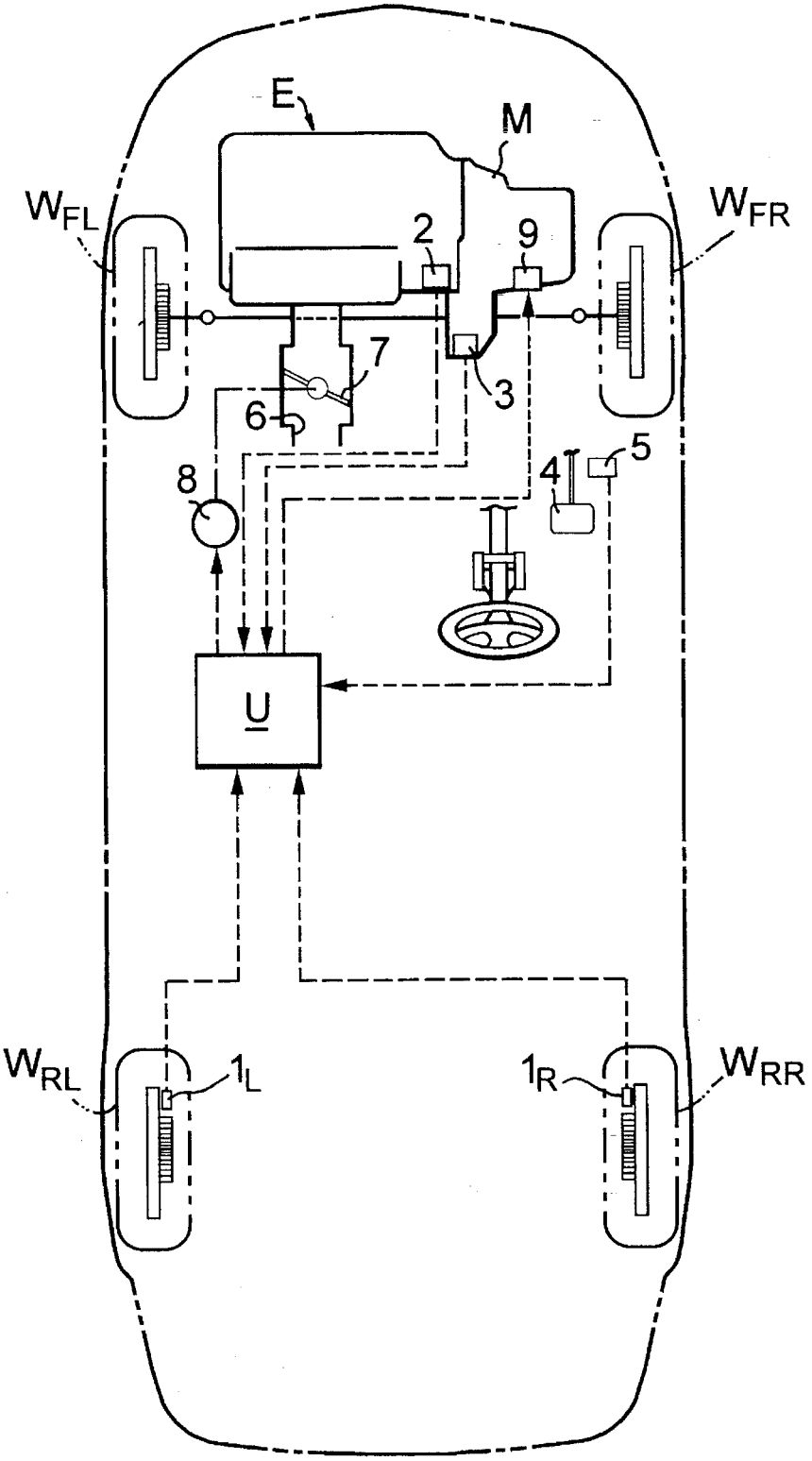
FIG. 1 is a diagrammatic illustration of a system arrangement of the present invention.

FIG. 1 shows a front wheel drive vehicle including a pair of left and right driven wheels $W_{FL}$ and $W_{FR}$, driven by an engine E, and a pair of left and right follower wheels $W_{RL}$ and $W_{RR}$. Follower wheel speed sensors $\mathbf{1}_L$ and $\mathbf{1}_R$, for detecting a vehicle speed V, are mounted on the follower wheels $W_{RL}$ and $W_{RR}$, respectively. An engine revolution-number sensor 2, for detecting the number NE of revolutions of the engine, is mounted on the engine E, and a shift position sensor 3, for detecting a shift position SPN, is mounted on automatic transmission M. An accelerator opening degree sensor 5 is mounted on accelerator pedal 4. A throttle valve 7 is mounted in an intake passage 6 of the engine E, and is electrically controlled, for opening and closing thereof, by a drive-by-wire through a pulse motor 8.

Signals from the follower wheel speed sensors $\mathbf{1}_L$ and $\mathbf{1}_R$, the engine revolution-number sensor 2, the shift position sensor 3 and the accelerator pedal opening degree sensor 5 are input to an electronic control unit U, including a microcomputer, where the signals are arithmetically processed, whereby the opening and closing of the throttle valve 7 is controlled through the pulse motor 8 driven by a command from the electronic control unit U. In order to control the shifting of the automatic transmission M, a shift solenoid 9, mounted on the automatic transmission M, is connected to the electronic control unit U.

The operation of the embodiment of the present invention, having the above-described construction, will be described below with reference to the flow chart in FIG. 2 and the block diagram in FIG. 3.

Figure 2:
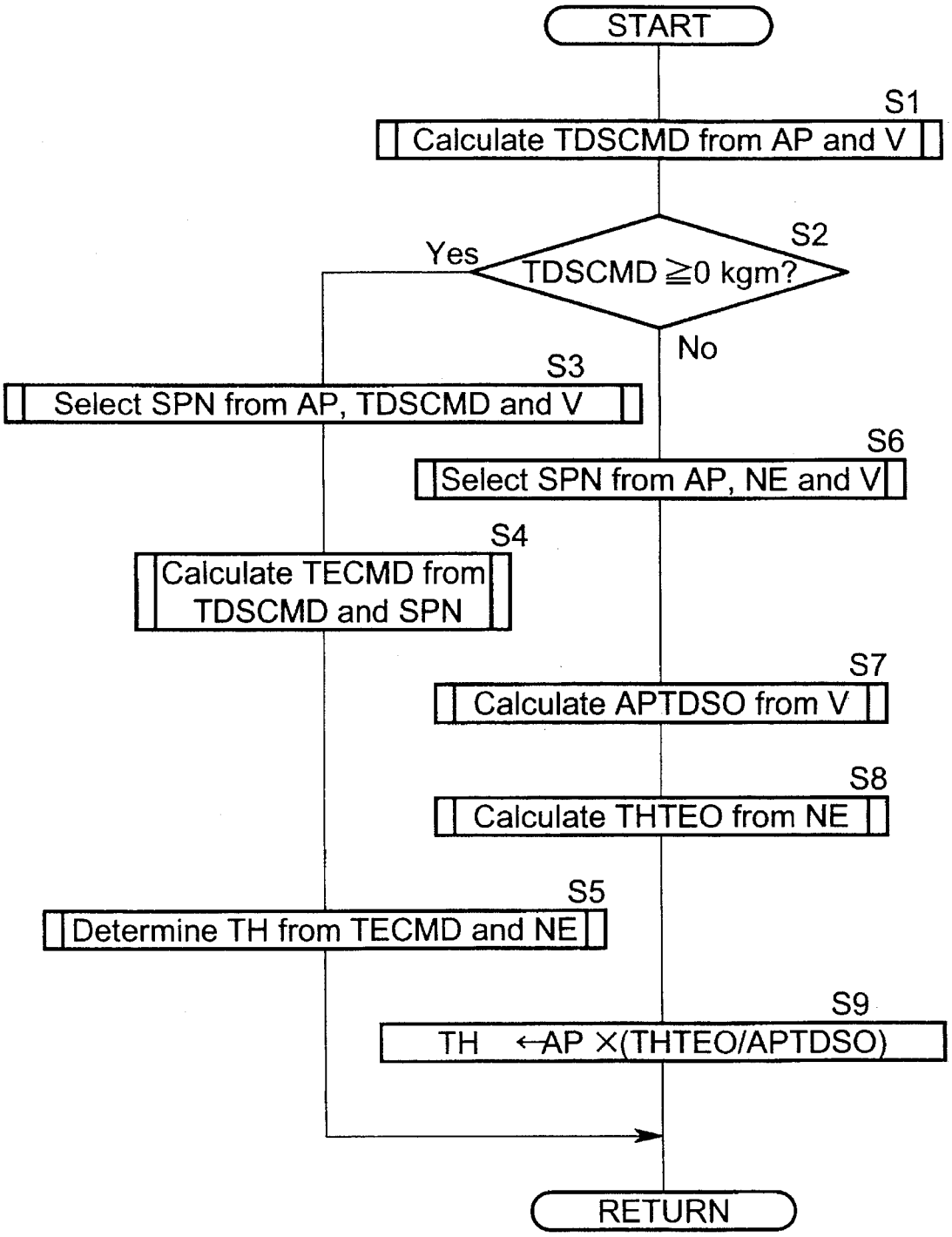
FIG. 2 is a flow chart for explaining the operation.
Figure 3:
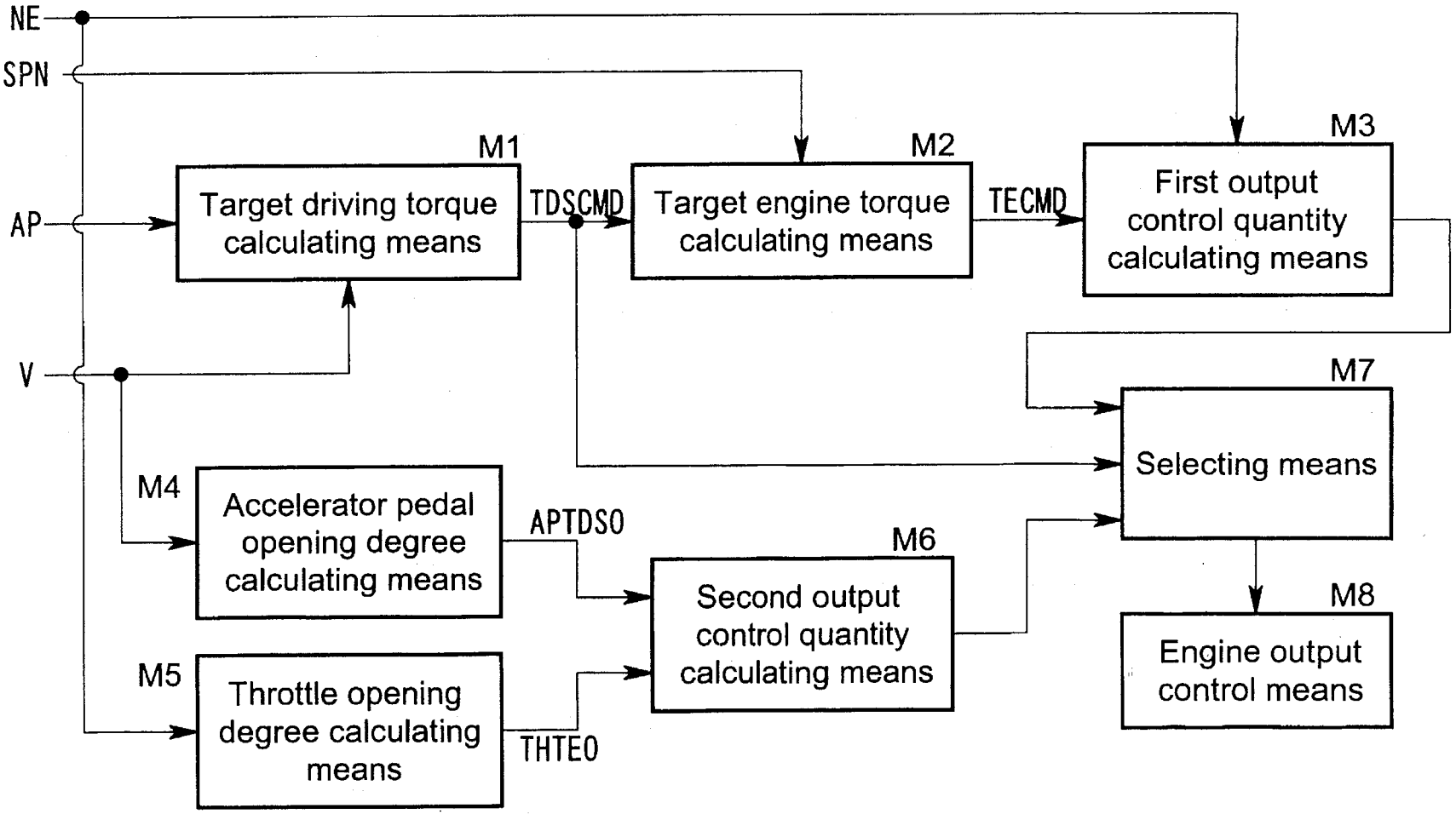
FIG. 3 is a block diagram of a control system.
Figure 4:
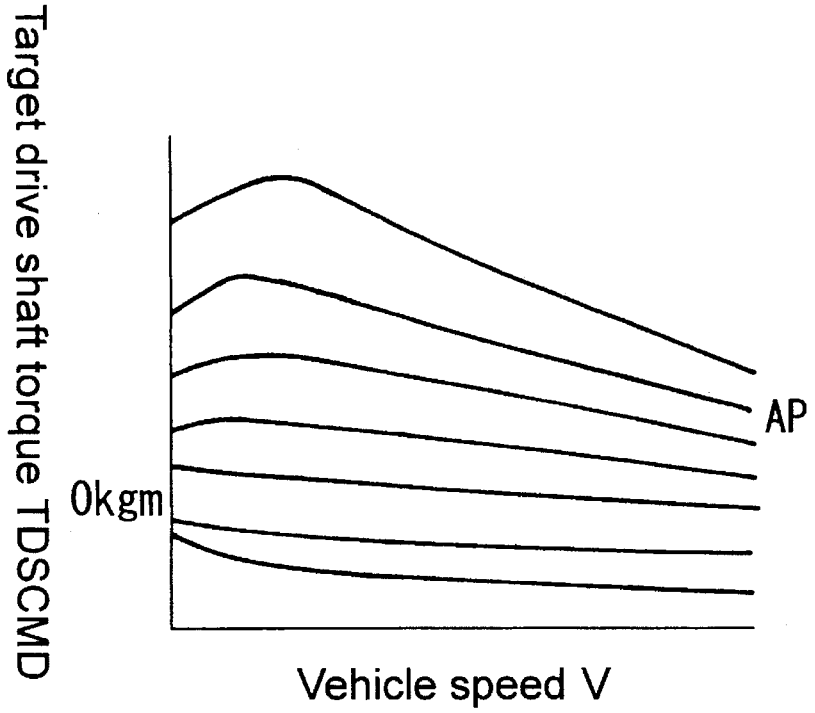
FIG. 4 is a map for determining a target driving torque TDSCMD.

At step S1, FIG. 2, a target driving torque calculating means M1, FIG. 3, searches a target drive shaft torque TDSCMD from the map in FIG. 4, based on an accelerator pedal opening degree AP, detected by the accelerator pedal opening degree sensor 5 and a vehicle speed V, detected by the follower wheel speed sensors $\mathbf{1}_L$ and $\mathbf{1}_R$. Then, at step S2, FIG. 2, a selecting means M7, FIG. 3, compares the target drive shaft torque TDSCMD with zero. If the target drive shaft torque TDSCMD is not negative, the processing is advanced to steps S3 to S5, FIG. 2 where a mode for determining the target throttle opening degree TH based on the target drive shaft torque TDSCMD is selected. If the drive shaft torque TDSCMD is negative, the processing is advanced to steps S6 to S9, FIG. 2, where a mode for determining the target throttle opening degree TH, proportional to the accelerator pedal opening degree AP, is selected.

Figure 5:
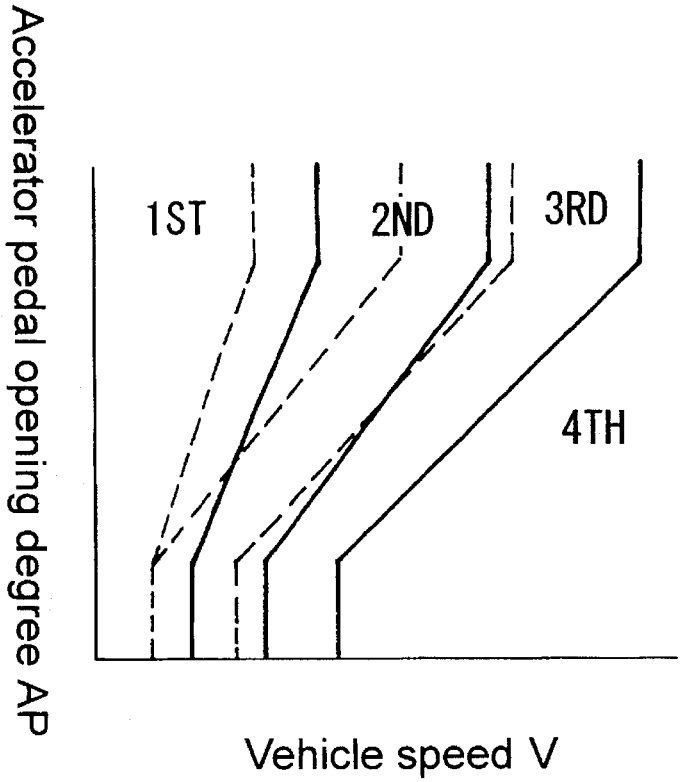
FIG. 5 is a map for determining a shift position SPN.

If the target drive shaft torque TDSCMD is not negative at step S2, FIG. 2, and if the former mode for determining the target throttle opening degree TH, based on the target drive shaft torque TDSCMD, is selected, a shift position SPN is selected at step S3, for example, from the map in FIG. 5, based on the accelerator opening degree AP, the target drive shaft torque TDSCMD and the vehicle speed V, and the shift solenoid 9 of the automatic transmission M is driven so as to establish such shift position SPN.

Then, at steps S4, a target engine torque calculating means M2, FIG. 3, calculates a target engine torque TECMD, based on the target drive shaft torque TDSCMD and the shift position SPN, detected by the shift position sensor 3. The target engine torque TECMD is provided, according to formula (1), which follows, by dividing the target drive shaft torque TDSCMD by a gear ratio GR in the currently established shift position SPN and by a torque ratio t of a torque converter:

$$TECMD=TDSCMD/(GR\times t) \quad (1)$$

Figure 6:
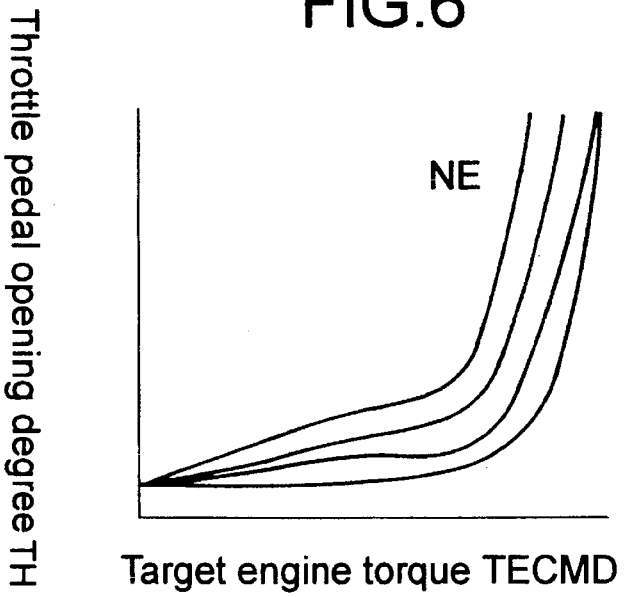
FIG. 6 is a map for determining a target throttle opening degree TH.

At step S5, FIG. 2, a first output control quantity calculating means M3, FIG. 3, searches a target throttle opening degree TH from the map in FIG. 6, based on the target engine torque TECMD and the engine revolution-number NE detected by the engine revolution-number sensor 2. In this manner, the target throttle opening degree TH, which is a first output control quantity for generating the target drive shaft torque TDSCMD is determined, when the target drive shaft torque TDSCMD is not negative.

If the target drive shaft torque TDSCMD is negative at step S2, FIG. 2, and the latter mode, for determining the target throttle opening degree TH in proportion to the accelerator pedal opening degree AP, is selected, a shift position SPN is selected at step S6, for example, from the map in FIG. 5, based on the accelerator opening degree AP, the engine revolution-number NE and the vehicle speed V, and the shift solenoid 9 of the automatic transmission M is driven so as to establish such shift position SPN.

Figure 7:
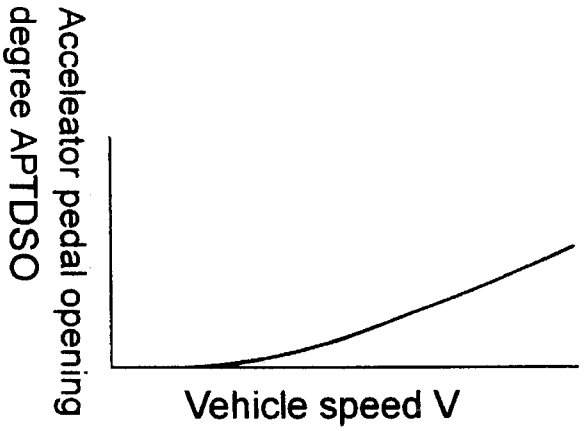
FIG. 7 is a map for determining an accelerator opening degree APTDSO.
Figure 9:
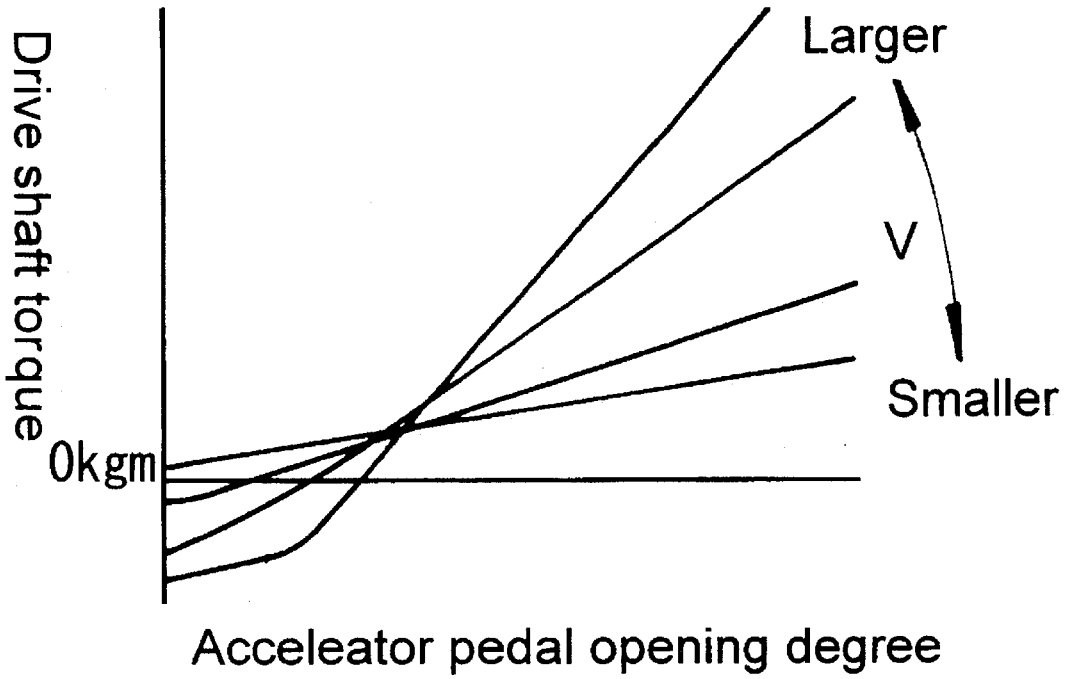
FIG. 9 is a graph illustrating the relationship between the accelerator opening degree and the drive shaft torque.

Subsequently, at step S7, an accelerator opening degree calculating means M4 searches an accelerator opening degree APTDSO at which the drive shaft torque is zero, from the map in FIG. 7. As is apparent from the graph in FIG. 9, the accelerator pedal opening degree, at which the drive shaft torque becomes zero, as the vehicle speed V is increased, has an increasing characteristic and hence, the map in FIG. 7 has a rightward rising characteristic. A map as shown in FIG. 7 may be prepared for each of the shift positions SPN, and a suitable map may be used in accordance with the current shift position SPN.

Figure 8:
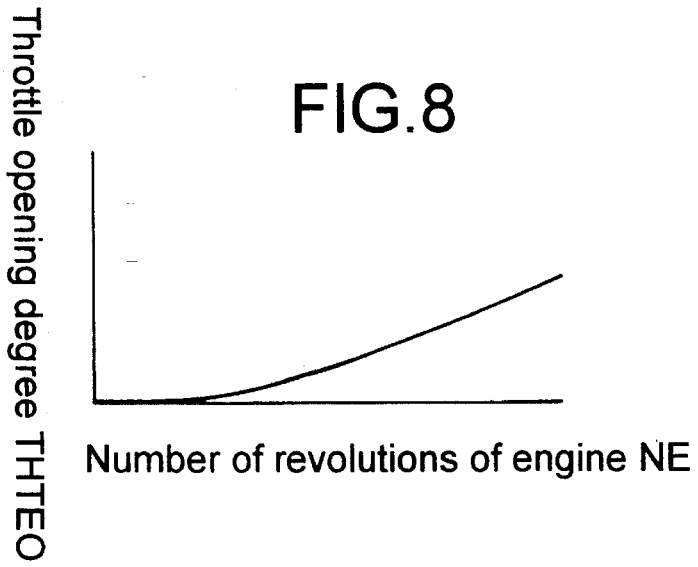
FIG. 8 is map for determining a throttle opening degree THTEO.
Figure 10:
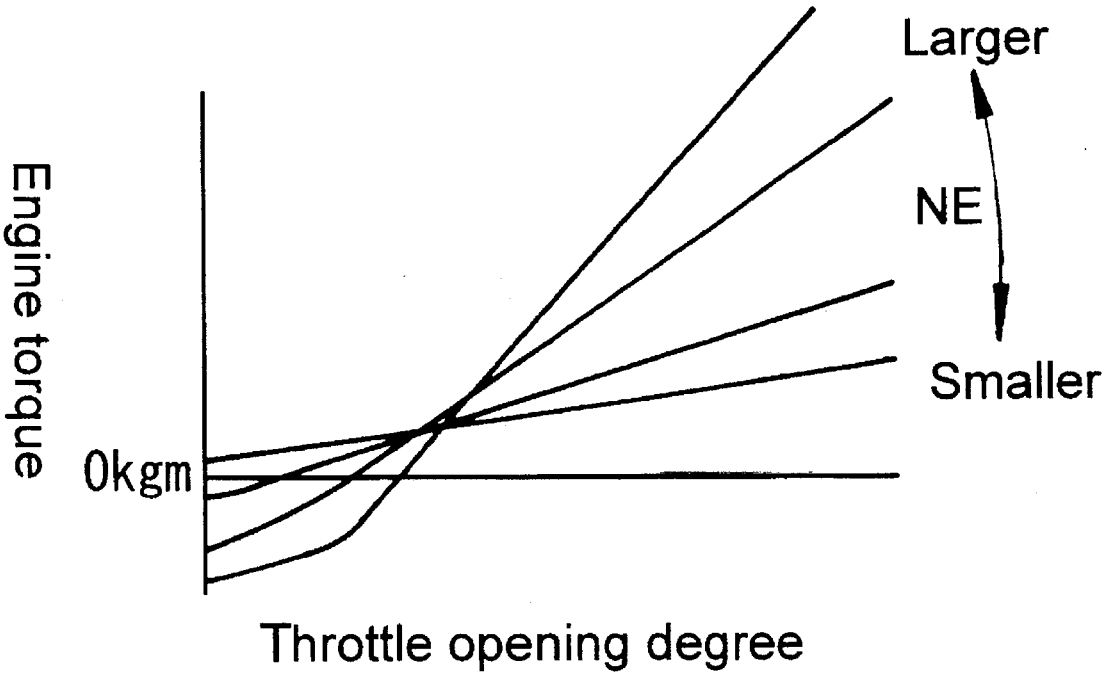
FIG. 10 is a graph illustrating the relationship between the throttle opening degree and the engine torque.

Subsequently, at step S8, FIG. 2, a throttle opening degree calculating means M5, FIG. 3, searches a throttle opening degree THTEO at which the engine torque is zero, from the map in FIG. 8. As is apparent from the graph in FIG. 10, the throttle opening degree at which the engine torque becomes zero as the engine revolution number NE is increased, has an increasing characteristic and hence, the map in FIG. 8 has a rightward rising characteristic. The throttle opening degree THTEO may be corrected in accordance with the engine coolant temperature, the atmospheric temperature, the service condition of an air conditioner and the like.

At step S9, FIG. 2, a second output control quantity calculating means M6, FIG. 3, calculates a target throttle opening degree TH which is a second output control quantity according to formula (2), which follows, based on the current accelerator pedal opening degree AP, the accelerator opening degree APTDSO at which the drive shaft torque becomes zero, and the throttle opening degree THTEO at which the engine torque becomes zero:

$$TH=AP\times(THTEO/APTDSO) \quad (2)$$

Figure 11:
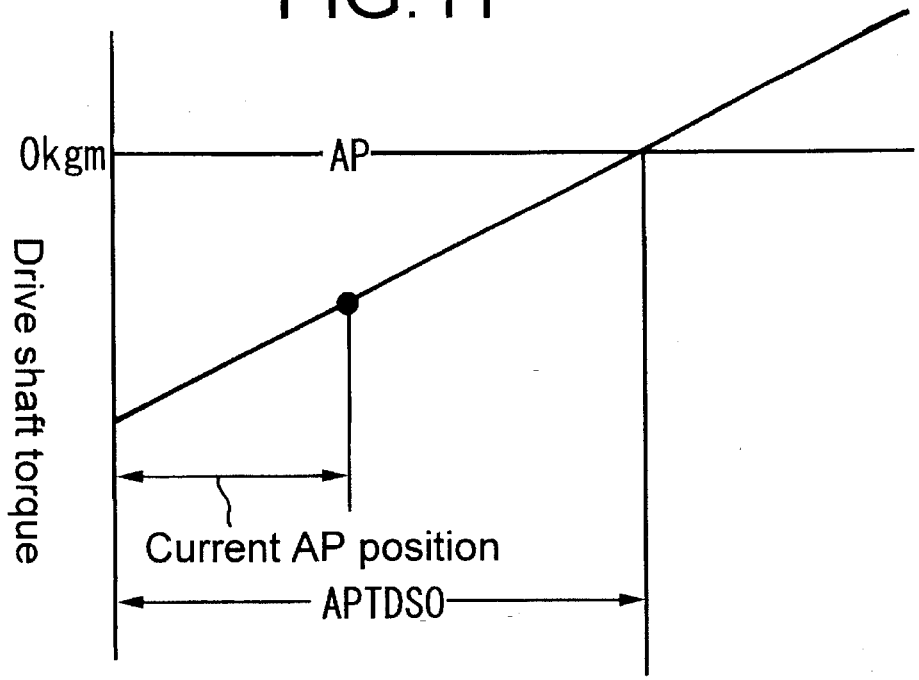
FIGS. 11 and 12 are graphs for explaining a technique for determining the target throttle opening degree.
Figure 12:
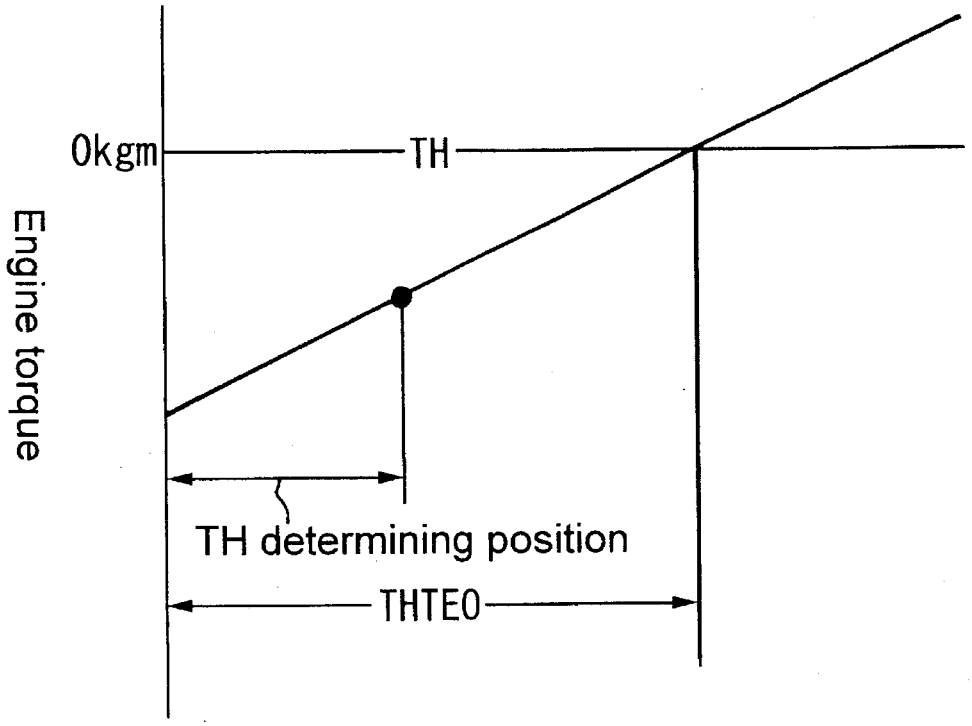

More specifically, if a proportional relation represented by formula (3), which follows, is established based on the accelerator opening degree APTDSO at which the drive shaft torque becomes zero, and based on the target throttle opening degree THTEO at which the engine torque becomes zero, on the assumption that the accelerator pedal opening degree AP and the target throttle opening degree TH are in a proportional relation in a negative range of the target drive shaft torque TDSCMD, as shown in FIGS. 11 and 12, the above-described formula (2) is derived from formula (3):

$$AP/APTDSO=TH/THTEO \quad (3)$$

If the target drive shaft torque TDSCMD is not negative in the above manner, the target throttle opening degree TH (see formula (1), supra) calculated at step S5 is defined as a target value, and the throttle valve 7 is driven toward this target value by the pulse motor 8, FIG. 1, serving as an engine output control means M8. Thus, in a range excluding a lower accelerator opening degree at which an engine brake is applied, the throttle valve 7 is controlled so as to provide a target drive shaft torque dependent on an actual accelerator pedal opening degree AP and, in this manner, it is possible to provide a driveability intended by a driver.

On the other hand, if the target drive shaft torque TDSCMD is negative, the target throttle opening degree TH (see formula (2), supra), calculated at step S9, is defined as a target value, and the throttle valve 7 is driven toward such target value by the pulse motor 8. At this time, as is apparent from formula (2), supra, the target throttle opening degree TH is in a proportional relation to the accelerator pedal opening degree AP and hence, when the driver releases his or her foot from the accelerator pedal, and the accelerator pedal opening degree becomes zero, the throttle valve 7, driven by the electronic control unit U, through the pulse motor 8, is also closed such that the opening degree of the throttle valve 7 correctly becomes zero. Therefore, for example, in an engine in which a fuel-cutting is conducted upon full closing of the throttle valve, it is possible to overcome problems that the throttle opening degree does not become correctly zero, even if the driver releases his or her foot from the accelerator pedal, and thus the fuel-cutting is not carried out, and the specific fuel consumption and driveability is eliminated and are deteriorated.

Although the embodiment of the present invention has been described in detail, it will be understood that the present invention is not limited to the above-described embodiment, and various modifications in design may be made without departing from the spirit and scope of the invention defined in the claims.

For example, in place of selection of any mode comparing the target drive shaft torque TDSCMD with zero at step 2 in the flow chart in FIG. 2, the following processing may be conducted: an accelerator opening degree APTDSO, at which the drive shaft torque becomes zero, may be calculated from the vehicle speed V and compared with the current accelerator opening degree AP. If AP≧APTDSO, the mode at steps S3 to S6 may be selected, and if AP<APTDSO, the mode at steps S6 to S9 may be selected.

As discussed above, according to the present invention, any one of the first output control quantity of the engine for generating the target driving torque and the second output control quantity proportional to the accelerator opening degree is selected, and the throttle opening degree is controlled based on the selected output control quantity. Therefore, it is possible to reconcile the engine output control for generating an engine output having the magnitude corresponding to the target driving torque intended by the driver, and the engine output control for allowing the accelerator opening degree to accurately coincide with the throttle opening degree in the lower accelerator opening degree range.

We claim:

1. An engine output control system for a vehicle for controlling engine output by electrically regulating throttle opening degree in accordance with accelerator opening degree, comprising:

a target driving torque calculating means for calculating target driving torque based on accelerator opening degree and vehicle speed;

a target engine torque calculating means for calculating target engine torque based on the target driving torque and shift position;

a first output control quantity calculating means for calculating first output control quantity of the engine based on the target engine torque and the number of revolutions of the engine;

an accelerator opening degree calculating means for calculating the accelerator opening degree at which the target driving torque is equal to or smaller than a first predetermined value, based on the vehicle speed;

a throttle opening degree calculating means for calculating the throttle opening degree at which the engine torque is equal to or smaller than a second predetermined value, based on the number of revolutions of the engine;

a second output control quantity calculating means for calculating a second output control quantity of the engine based on the accelerator opening degree calculated in the accelerator opening degree calculating gears and the throttle opening degree calculated in the throttle opening degree calculating means;

a selecting means for selecting one of the first and the second output control quantity, based on the target driving torque; and an engine output control means for controlling the engine output based on the selected one of the first and second output control quantity.

2. An engine output control system for a vehicle according to claim 1, wherein said first predetermined value is zero, and said second predetermined value is zero.

3. An engine output control system for a vehicle according to claim 1, wherein said selecting means selects the second output control quantity, when said target driving torque is not larger than said first predetermined value.

* * * * *